US005865605A

United States Patent [19]

Weidlein

[11] Patent Number: 5,865,605

[45] Date of Patent: Feb. 2, 1999

[54] METHOD AND APPARATUS FOR REMOVING A HIGH PRESSURE IN-TANK PUMP USING A LOW PRESSURE TUBE

[75] Inventor: Glenn L. Weidlein, Hampton, Va.

[73] Assignee: Chicago Bridge & Iron Company, Plainfield, Ill.

[21] Appl. No.: 821,359

[22] Filed: Mar. 20, 1997

[51] Int. Cl.[6] ..... F04B 17/00; F04B 35/04; F04B 15/08

[52] U.S. Cl. ..... 417/360; 417/53; 417/423.3; 417/423.15; 417/901

[58] Field of Search ..... 417/53, 360, 361, 417/422, 423.3, 423.15, 424.1, 901

[56] References Cited

U.S. PATENT DOCUMENTS

| | | | |
|---|---|---|---|
| 4,080,106 | 3/1978 | Haesloop | 417/360 |
| 4,435,132 | 3/1984 | Haesloop et al. | 417/442 |
| 4,472,946 | 9/1984 | Zwick | 417/901 |
| 4,500,263 | 2/1985 | Mohn | 417/360 |

*Primary Examiner*—Charles G. Freay
*Attorney, Agent, or Firm*—Marshall, O'Toole, Gerstein, Murray & Borun

[57] ABSTRACT

Apparatus are disclosed which include a low pressure tube through which a pump discharge line can extend. The tube is sealed in at least two separate elevations to define a purge zone that can be purged of all volatile gases and permit the discharge line to be raised vertically through the low pressure tube.

42 Claims, 7 Drawing Sheets

METHOD AND APPARATUS FOR REMOVING A HIGH PRESSURE IN-TANK PUMP USING A LOW PRESSURE TUBE

FIELD OF INVENTION

This invention relates generally to in-tank pumping systems for cryogenic fluid storage tanks, and more particularly to a method and apparatus for removing an in-tank pump while the tank remains in service.

BACKGROUND OF THE INVENTION

Storage tanks for cryogenic fluids must be capable of maintaining the cryogenic fluid at extremely low temperatures (about −250° F. to −150° F.) and pressures (0.5 psig to 2 psig). Such tanks are used at liquefied natural gas storage sites and onboard ships. A pump to transfer the cryogenic fluid from the tank to another destination is typically capable of discharge pressures greater than 1000 psi.

If a large tank storing liquefied cryogenic fuel, such as liquefied natural gas, were to have a pipe line joined near the bottom of the tank, any pipe line failure could lead to the tank being emptied and the possibility that property in the vicinity could be damaged. To ensure that such a failure can not occur, discharge lines from cryogenic tanks exit the top of the tanks. With such an arrangement, it is necessary to place a high-pressure pump in the tank to pump liquid up the height of the tank through a discharge pipe.

To withstand high internal pressures, a discharge line must have thick walls. Further, to withstand the extreme cold temperatures of the cryogenic fluids the material used to make the pipe must be stainless steel or other cryogenic materials. Complicating the pump and discharge line arrangement in cryogenic storage tanks is that the pump requires electrical power and suitable electrical cables must be run into the tank and to the pump.

Further, a high-pressure pump must be disposed in the tank in such a manner that it can be removed for maintenance, repair, or replacement when necessary without draining the tank and taking the tank out of service, which can cost considerable time and resources.

One means for removing a pump from a cryogenic fluid storage tank includes a large diameter high-pressure pipe that acts both as a discharge line and a chamber for isolating the pump from the cryogenic tank contents during installation and removal. Failure to isolate the tank contents from an opening in the tank could result in the contents boiling off rapidly and escaping into the atmosphere. To isolate the contents, the high-pressure pipe includes at its lower end a foot valve that is normally closed but which can be opened simply by resting the pump on the foot valve. During installation, with the high-pressure pipe empty, the pump is lowered on a cable until it is near the bottom of the pipe. Before the valve is opened by setting the pump on the foot valve, a seal is placed near the top of the pipe so that the rush of cryogenic fluid into the pipe does not create a hazardous condition to the workers above. Once the seal is in place, the pump can be lowered to the bottom of the pipe and onto the valve to open the valve and permit the cryogenic fluid to flow into the pipe and be available to the pump.

To remove the pump, the high-pressure pipe is purged using inert gas at a pressure that is higher than that of the tank's contents. Once the high-pressure pipe is purged, the pump is raised by a cable to close the foot valve and seal the tank's contents from the high-pressure pipe.

Consequently, a high-pressure pipe for use in a cryogenic liquid storage tank must: extend from the top to the bottom of the tank; have a large enough internal diameter to accommodate the pump as it is installed and removed; have adequate strength to resist extremely high internal pressures; and be made of materials that can withstand the extreme cold of the cryogenic fluid. Such pipes are extremely expensive to build, maintain, and install.

A need exists for a method and apparatus for installing and removing a pump from a cryogenic liquid storage tank without the use of a large diameter, high-pressure discharge pipe.

SUMMARY OF THE INVENTION

The present invention does not require the use of a large diameter, high-pressure discharge pipe to accommodate installation and removal of a pump while the tank remains in service. The invention uses a discharge pipe that is substantially smaller in diameter and results in significant cost savings. Such an inventive apparatus includes: a tube having a bore therethrough; a discharge pipe disposed in and extending through the tube bore, and having a pump mount; a first seal joined to the discharge pipe at a first elevation; a second seal joined to the discharge pipe at an elevation below the first seal elevation, the second seal spaced apart from the first seal to define a venting zone therebetween; a third seal joined to the discharge pipe at an elevation below the second seal elevation, the third seal spaced apart from the second seal to define a purge zone therebetween; and means for purging the purge zone.

In addition, the apparatus may include a fourth seal joined to the discharge pipe at an elevation below the third seal elevation to define a second purge zone that may be purged by raising the discharge tube to engage the second purge zone with the means for purging the purge zone. The tube may include a cone-shaped lower inlet to receive the fourth seal as it rises with the discharge pipe. Additional seals can be joined to the discharge pipe to serially define purge zones between seals as the discharge pipe is raised through the tube.

A last seal may be joined to the bottom of the pump to define a last purge zone that permits removal of the pump after that zone is purged of any tank contents that may be entrapped therein.

The means for purging the purge zone may include, a purge tube in fluid communication with the tube bore at a fixed elevation between the second seal elevation and the third seal elevation; and means for feeding an inert gas through the purge tube into the purge zone. The means may further include a vent tube to vent the purge zone, or the vent zone or both.

The seals may include an electrical cable orifice and an orifice seal through which electrical supply cables can pass and be raised and lowered with the discharge pipe and seals.

The discharge pipe may be constructed with pipe segments that are joined with standard high-pressure mechanical pipe couplings. The discharge pipe may also require lateral bracing from earthquakes and the like. Such bracing may include a plurality of brace tubes mounted in the tank, the brace tubes defining bores through which the discharge pipe extends and in which the seals can be slidably disposed; and brace tube bumpers mounted on the seals for engaging the brace tube and transmitting lateral stability from the brace tubes to the discharge pipe.

The apparatus may also include a torque-resistant pump seat to engage the tank and resist pump torque.

The tube itself can be disposed in the tank, above the tank, or partially in the tank. During pump removal operations it is desirable to have the tube's lower end positioned above the level of liquid in the tank to minimize the amount of liquid that must be purged from the various purge zones as the seals are raised upward and into contact with the tube.

DETAILED DESCRIPTION OF DRAWINGS

Figure 1:
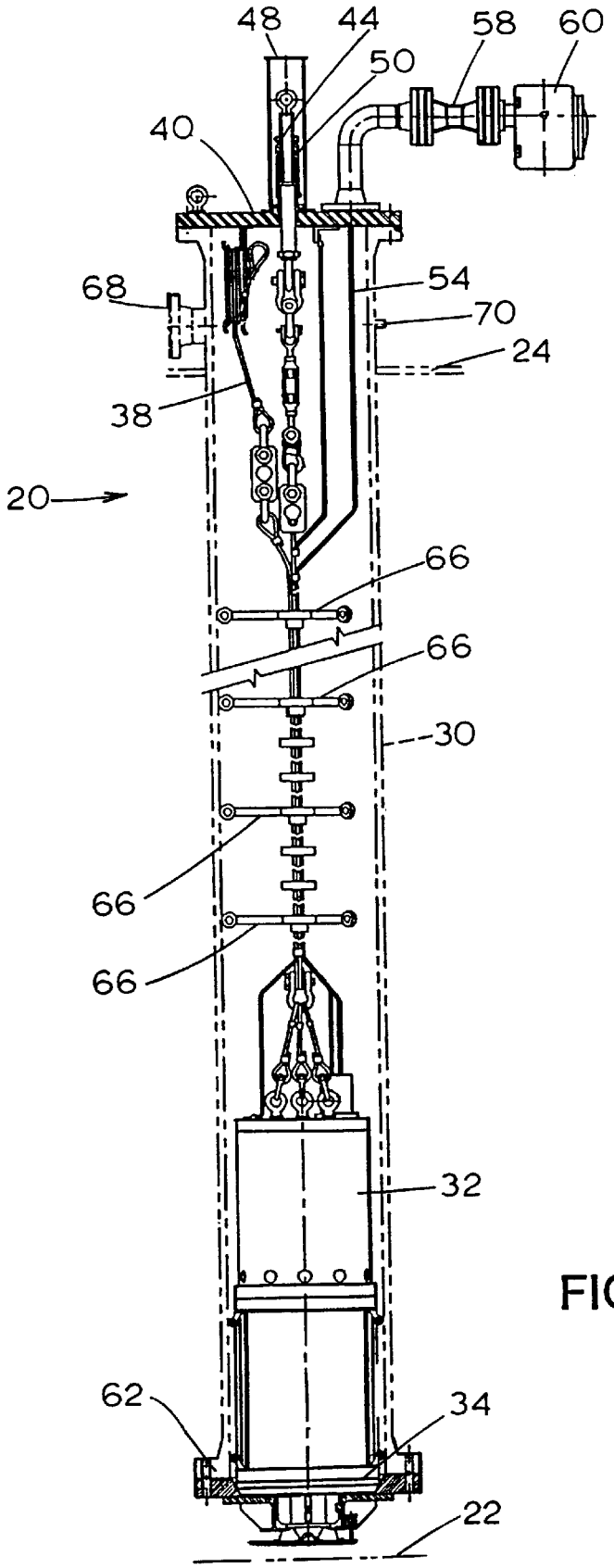
FIG. 1 is an elevational view of a prior art high-pressure pump tube.

To the extent practical, the same reference numerals will be used for the same or similar elements in each of the figures. Illustrated generally in FIG. 1 is a prior art submerged motor pump-removal system 20 positioned inside of a tank having a tank bottom 22 and a tank roof 24. Because the tank is used to store cryogenic fluid, there is preferably included an inner tank roof 26. A high pressure column 30 is disposed in the tank and extends between the tank bottom 22 and the tank roof 24. The high-pressure column 30 is designed to withstand high internal pressures and is preferably constructed of stainless steel.

Near the bottom of the inside of the high-pressure column 30, there is positioned a pump 32 that is able to pump cryogenic fluid up through the high-pressure column 30. Before the pump 32 is installed, the interior high pressure column 30 is isolated from the tank's contents because a normally closed foot valve 34 is positioned at the bottom of the high-pressure column 30. When the pump 32 is placed on the foot valve 34 a spring (not illustrated) is urged downward to open the valve 34.

Having the foot valve 34 closed until needed permits the installer of the pump 32 to lower the pump 32 via a hoist cable 38 into the high-pressure column 30 until the pump 32 is positioned slightly above the foot valve 34. At that point, a cap plate 40 is placed over the top of the high pressure column 30 and the pump 32 is lowered to the bottom of the high-pressure column 30 to open the foot valve 34. The tank's contents will not boil off in significant amounts because a pump lifting shaft 44 extends through an orifice in the cap plate 40 which minimizes the exposure to atmosphere of any tank contents that may flood the high-pressure column 30 as the pump 32 is lowered into place. Once in place, the pump lifting shaft 44 can be covered with a lift shaft cover 48 to seal the entire high-pressure column 30. To further seal the pump lifting shaft 44, a sealing gland 50 can be affixed to both the cap plate 40 and the pump lifting shaft 44 prior to lowering the pump 32 onto the foot valve 34. The sealing gland 50 is flexible and able to accommodate the final several feet of decent by the pump 32 and still provide an adequate seal prior to the lift shaft cover 48 being installed.

Electrical cable 54 must also be fed through the high-pressure column 30 down to the pump 32. The electrical cable 54 extends upwardly with the hoist cable 38 for most of the length of the high-pressure column 30 until it passes through the cap plate 40 and into a double seal terminal header 58. A junction box 60 provides a source of power to be transmitted through the electrical cable 54.

When the pump 32 starts up, the torque induced by the pump 32 is restrained by a high-pressure column flange 62 bolted to the tank bottom 22.

Roller guides and cable brackets 66 maintain general concentricity of the hoist cable 38 and the electrical cable 54 in the high-pressure column 30 while providing low resistance to vertical movement of the cables 38 and 54 and the pump 32.

Once in place, the pump 32 maintains the foot valve 34 in an open position to permit the liquid stored in the tank to flood the high-pressure column 30 to roughly an elevation of the liquid within the tank. The pump 32 then directs a flow of liquid up through the high-pressure column 30 and out of a discharge 68 where it can flow through additional conduits (not illustrated) to other points in the distribution system.

At various times, it may be desirable to remove the pump 32 from the high-pressure column 30 for repair, maintenance, or replacement. To remove the pump 32, it is necessary to purge the high-pressure column 30 with an inert gas, remove the lift shaft cover 48, and engage the pump lifting shaft 44 with an appropriate crane or other hoisting means.

Inert gas such as nitrogen can be fed through an inert gas purge port 70 to force as much of the liquid back out of the foot valve 34 as possible prior to the foot valve 34 being closed. Once the high-pressure column 30 has been substantially purged, the pump 32 can be hoisted by hoist cable 38 up through the high-pressure column 30 to close the foot valve 34. When the pump 32 reaches the top and the top seal plate 40 is removed, the pump 32 is pulled out.

While this arrangement has provided satisfactory results in prior installations, it is extremely expensive because it requires the use of a large internal diameter high-pressure column 30 made of stainless steel or other cryogenic steel extending long distances from the tank bottom 22 to the tank roof 24. Understandably, such a column requires the use of substantial amounts of costly materials and effort to build.

Figure 2A:
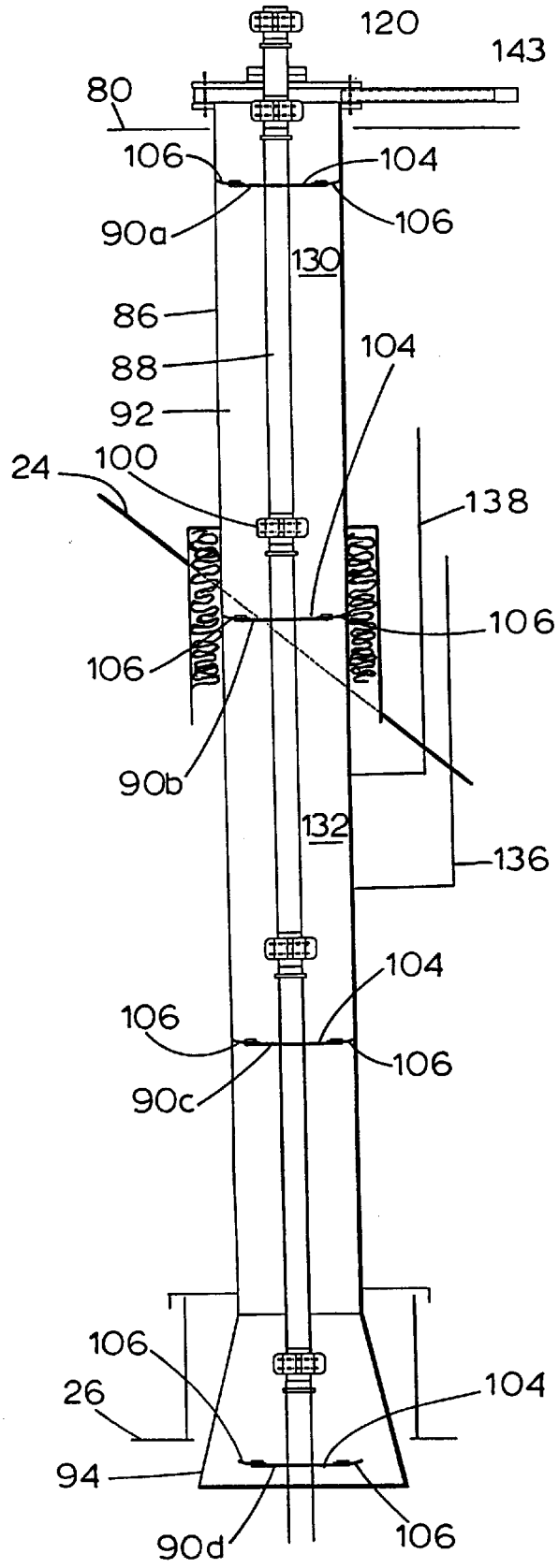
FIGS. 2A and 2B are partial elevational views of an apparatus in accordance with the present invention with FIG. 2A being an upper portion and FIG. 2B being a lower portion.
Figure 2B:
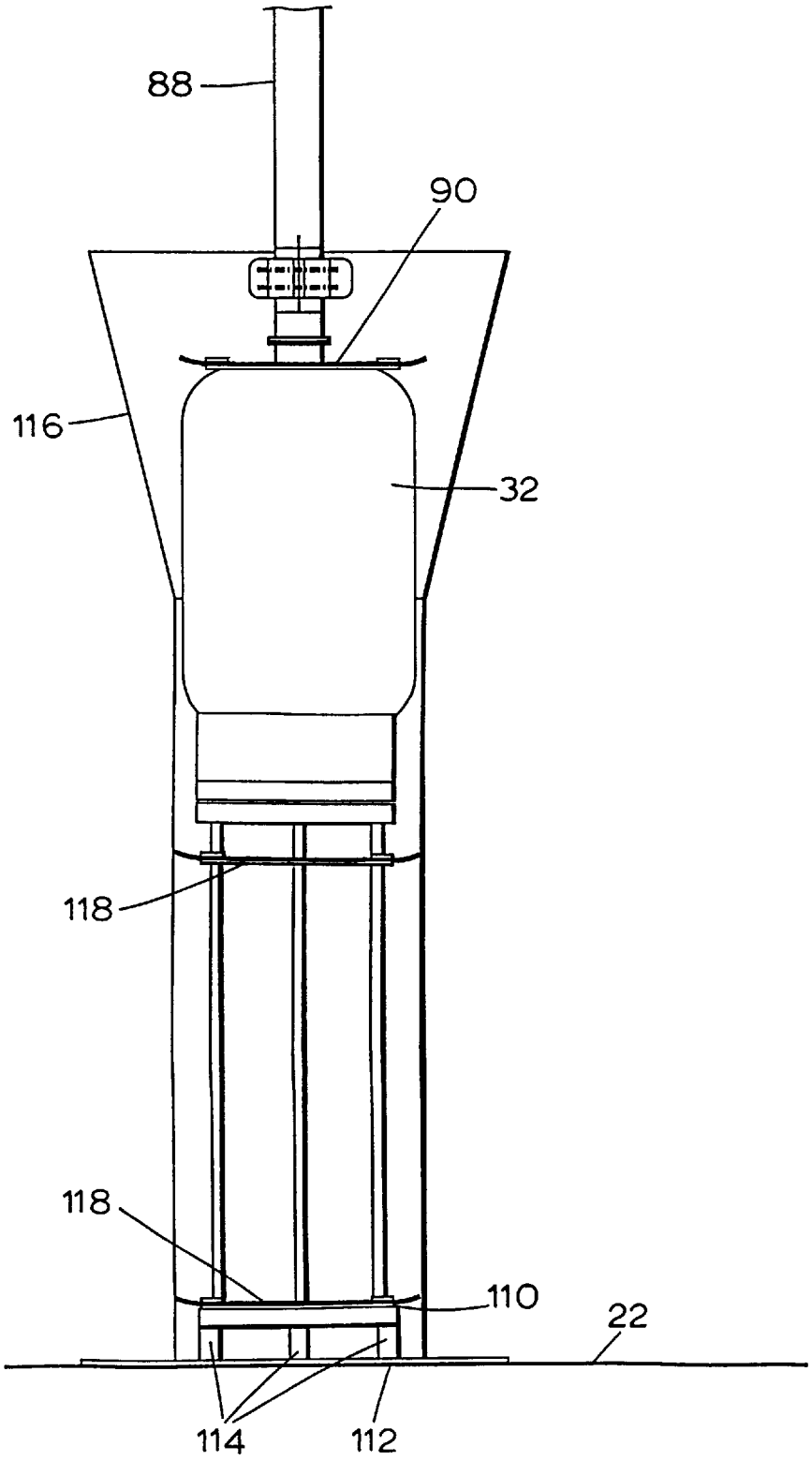

Referring to FIGS. 2A and 2B, there is depicted apparatus for overcoming the need to use a high-pressure column 30. Such an apparatus can be used in conjunction with a tank having a tank bottom 22, a tank roof 24, and an inner tank roof 26. The tank roof 24, as illustrated, is depicted at an angle relative to the horizontal so a work platform 80 is provided above the tank roof 24 on which workmen can stand.

The apparatus includes a low pressure tube 86, a discharge pipe 88 disposed in and extending through the low pressure tube 86, and a number of seals 90 joined to the discharge pipe 88.

As illustrated, the low pressure tube 86 has a bore 92 therethrough, and the low pressure tube 86 extends from its upper end at the work platform 80 downward to a level slightly below the inner tank roof 26. The low pressure tube 86 is sized to permit the pump 32 to be raised and lowered therethrough, but because it does not serve as a discharge for the pump 32, the low pressure tube 86 need not be constructed to extend through the entire elevation of the tank or to withstand high internal pressures from the pump 32. As illustrated, the lower end of the low pressure tube 86 includes a cone-shaped portion 94 which serves as a guide for upwardly moving seals 90 as will be described in detail below.

The discharge pipe 88 extends from its upper end through the low pressure tube bore 92 and downward to near the tank bottom 22 where it is coupled to the pump 32. This discharge pipe 88 is dramatically smaller in diameter than the high-pressure column 30 described above, and is adequate to receive enough discharge for all practical purposes. Because the discharge pipe 88 has such a smaller diameter, it can be constructed at a reduced cost compared to the high-pressure column 30.

The discharge pipe 88 is made up of a number of pipe segments. The length of the pipe segments is not critical, however the lengths may be controlled by the capacity of hoist or crane for raising and lowering the pump 32 from the tank. For example, if such a crane has a ten-foot capacity, it is desirable to have pipe segments approximately ten feet in length. With the invention, hoist cables 38 are not necessary to raise and lower the pump 32 because the discharge pipe 88 serves this function by being mounted to the pump 32 in a manner that is able to suspend the pump 32 from the discharge pipe 88. The crane lowers discharge pipe 88 segments and a pump 32 at ten foot intervals, and as each pipe segment is lowered to the top of the work platform 80, another discharge pipe 88 segment is added and coupled to the previous discharge pipe segment. Discharge pipe 88 segments are coupled with high-pressure mechanical couplings 100 and discharge pipe 88 segments are added until the pump 32 has been lowered to the desired elevation within the tank.

To prevent liquid within the tank from boiling up through the low pressure tube 86, a plurality of seals 90 are provided to seal the low pressure tube bore 92. The seals 90 each include a seal plate 104 that has a slightly smaller outside diameter than the inside diameter of the low pressure tube 86. Seal wipers 106 fixed to the perimeter of the seal plate 104 provide an adequate seal for the low pressure tube 86 while the pump 32 and discharge pipe 88 are being lowered into the tank. The seal plate 104 is preferably made of stainless steel or aluminum and the seal wiper 106 is preferably made of flexible Teflon™.

Once the pump 32 has been lowered to near the tank bottom 22 a torque resisting pump seat 110 (FIG. 2B) engages a mating floor coupling 112 in the tank bottom 22. The torque resisting pump seat 110 can include a series of downwardly extending dogs 114 which may, but need not, engage mating recesses (not illustrated) in the floor coupling 112. As the pump 32 begins to operate, its torque will cause the pump seat 110 to rotate slightly to engage the dogs 114 into the recesses of the floor coupling 112 thereby providing adequate torque resistance.

To guide the pump seat 110 into engagement with the floor coupling 112 as the pump 32 is being lowered, a funnel-shaped tube 116 is positioned concentrically above the floor coupling 112 to receive and guide the pump seat 110 downward. Pump seals 118 aid in guiding the pump seat 110 and provide a seal in the low pressure tube when the pump 32 is being installed and removed.

The top of the low pressure tube 86 (FIG. 2A) is preferably sealed with a cap plate 120 (described in detail below) to provide adequate sealing while the pump 32 is in normal operation. When the pump 32 requires repair or replacement, it is preferably done without removing all of the contents of the tank because the cost for emptying the tank can be extremely expensive and time consuming. To remove the pump 32 from the tank, all that is necessary is for the cap plate 120 to be removed to enable the discharge pipe 88 to be hoisted upward by a suitable crane or other hoisting means, through the low pressure tube 86, and out of the tank.

In the first stage of pump removal, the uppermost seal 90*a* is positioned at a first elevation within the low pressure tube 86, and a second seal 90*b*, spaced below the first seal 90*b* to define a vent zone 130. Beneath the second seal 90*b* there is positioned a third seal 90*c* which is fixed to the discharge pipe 88 and spaced apart from the second seal 90*b* to define a purge zone 132. The vent zone 130 can be vented of any harmful gases that have collected therein during the operation of the pump 32 and the tank through vent line 138. A purge line 136 can be used to inject an inert gas such as nitrogen into the purge zone 132 at a pressure that is slightly higher then the internal contents of the tank. For example, the tank internal pressure may be approximately 1 to 2 psi while the nitrogen purge line 136 can provide nitrogen at about 3 psi to force gas in the purge zone 132 past the seal wiper 106 in both the second seal 90*b* and the third seal 90*c*. To verify that the purge zone 132 has been adequately purged, a nitrogen gas detector (not illustrated) can be positioned near the top of the low pressure tube 86 to verify that nitrogen has indeed purged the purge zone 132 and passed through the vent zone 130. To enhance the purging of the purge zone 132, the vent line 138 can be used to receive any gases that are circulating within the purge zone 132.

Once it has been established that the purge zone 132 is purged, the discharge pipe 88 can be raised to bring at least the first pipe segment and the first seal 90*a* out of the top of the low pressure tube 86. In so doing, the second seal 90*b* and the third seal 90*c* will be raised up within the low pressure tube 86 to establish a new vent zone 130.

A fourth seal 90*d* will be raised into the low pressure tube 86 to engage the low pressure tube bore 92 to define a new purge zone 132. The purge zone 132 will rise with the discharge pipe 88 until a high pressure mechanical coupling 100 can be reached by workmen on the work platform 80 to disengage the top segment of discharge pipe 88. When this elevation is reached, the new purge zone 132 will be at the same elevation as the purge line 136 and the vent line 138. The process described above for purging the purge zone 132 and venting the vent zone 130 is repeated and the discharge pipe 88 is raised to sequentially remove pipe sections until the discharge pipe 88 is entirely removed from the tank.

The final segment of pipe 88 is fixed to the pump 32 and beneath the pump 32 there is a pair of pump seals 118 that act in an identical fashion to the other seals 90 to define a last purge zone.

Figure 3:
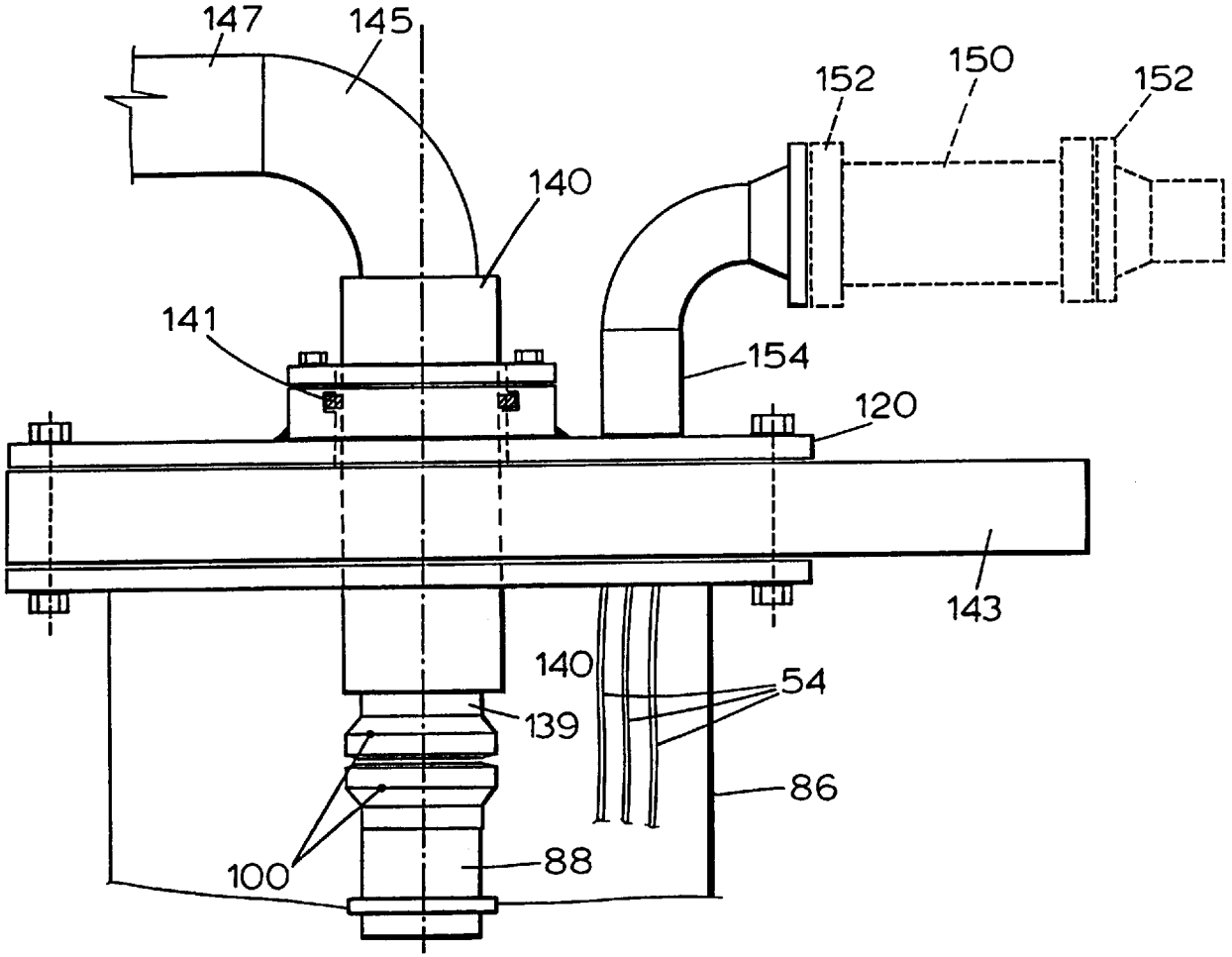
FIG. 3 is a detailed elevation view of a pump tube top head.

Next, FIG. 3 depicts details of a seal and head assembly for the top of the low pressure tube 86. As depicted, the low pressure tube 86 contains therein a discharge pipe 88. An upper end of the discharge pipe 88 is joined to the seal and head assembly with a high pressure mechanical coupling 100. The seal and head assembly includes a downwardly extending pipe segment 139 that is disposed in a slightly larger packing tube 140. The packing tube 140 is joined to a vertical contraction packing assembly 141.

The vertical contraction packing assembly 141 is provided to accommodate elevation changes in the tank roof 24 relative to the tank bottom 22 that occur as the tank expands and contracts with varying amounts of cryogenic fluid stored therein. Such a vertical contraction packing assembly 141 provides for enough vertical movement in the discharge pipe 88 so that the pump 32 is not lifted off of the tank bottom 22 should the tank roof 24 raise up in elevation. The vertical contraction packing assembly 141 has an inside diameter that is adequate to accommodate the outside diameter of a high pressure mechanical coupling 100 as it is removed from the tank.

When the pump 32 is raised up from the low pressure tube 86, a sliding gate valve 143 is opened to accommodate the pump 32. Extending upwardly from the vertical contraction packing assembly 141 is an elbow 145 and additional conduit 147 which feeds the cryogenic fluid down stream.

On the right hand side of FIG. 3 there is depicted a terminal electric header 150 of standard construction which includes a double seal 152 through which electrical cable 54 passes to a power source. The terminal electrical header 150 includes an electrical conduit 154 through which electrical cable 54 extends downward into the low pressure tube 86 and is connected to the seals 90 as described above.

Figure 4:
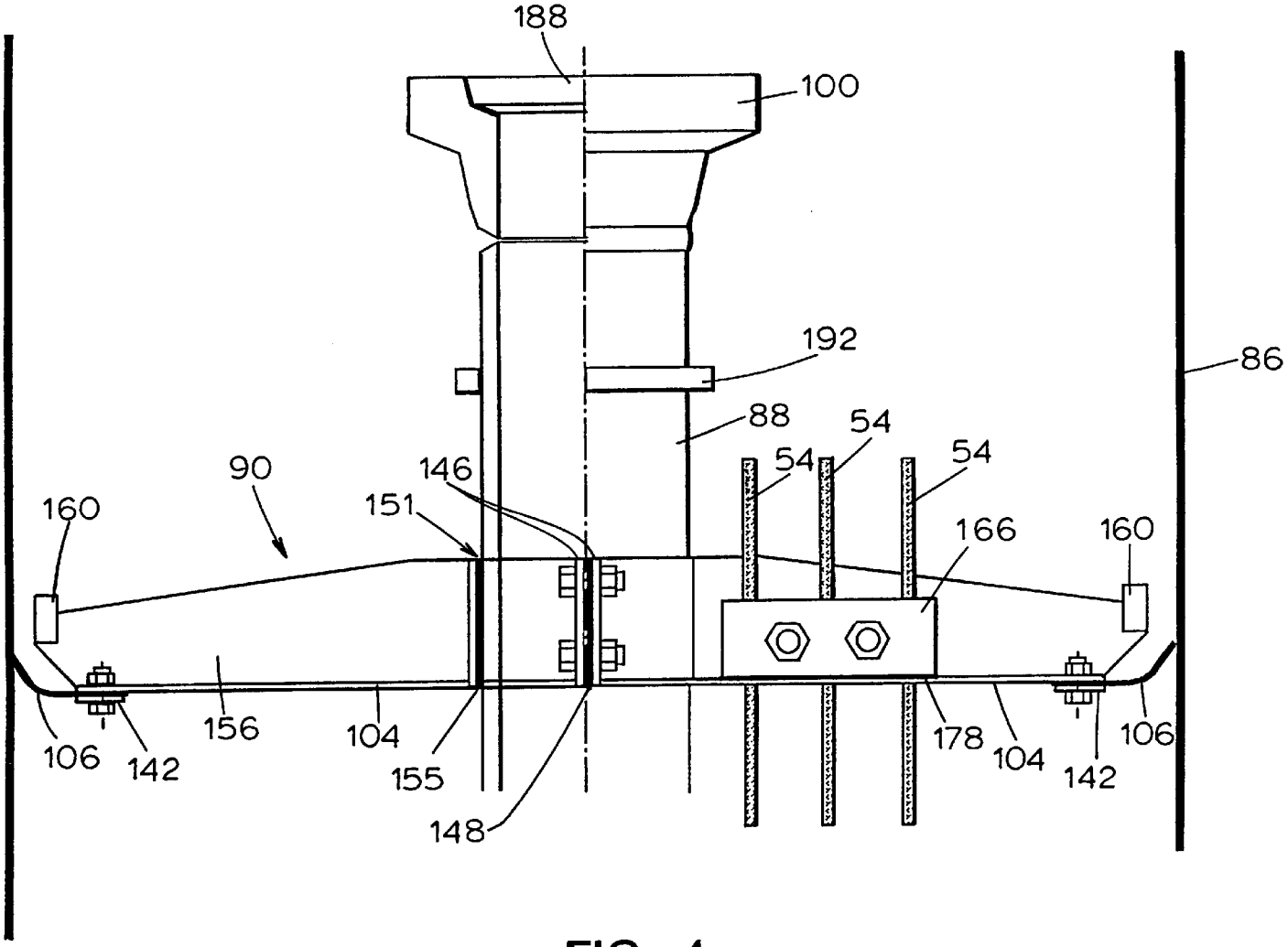
FIG. 4 is a partial cross-sectional elevation of seal to be used with the present invention.
Figure 5:
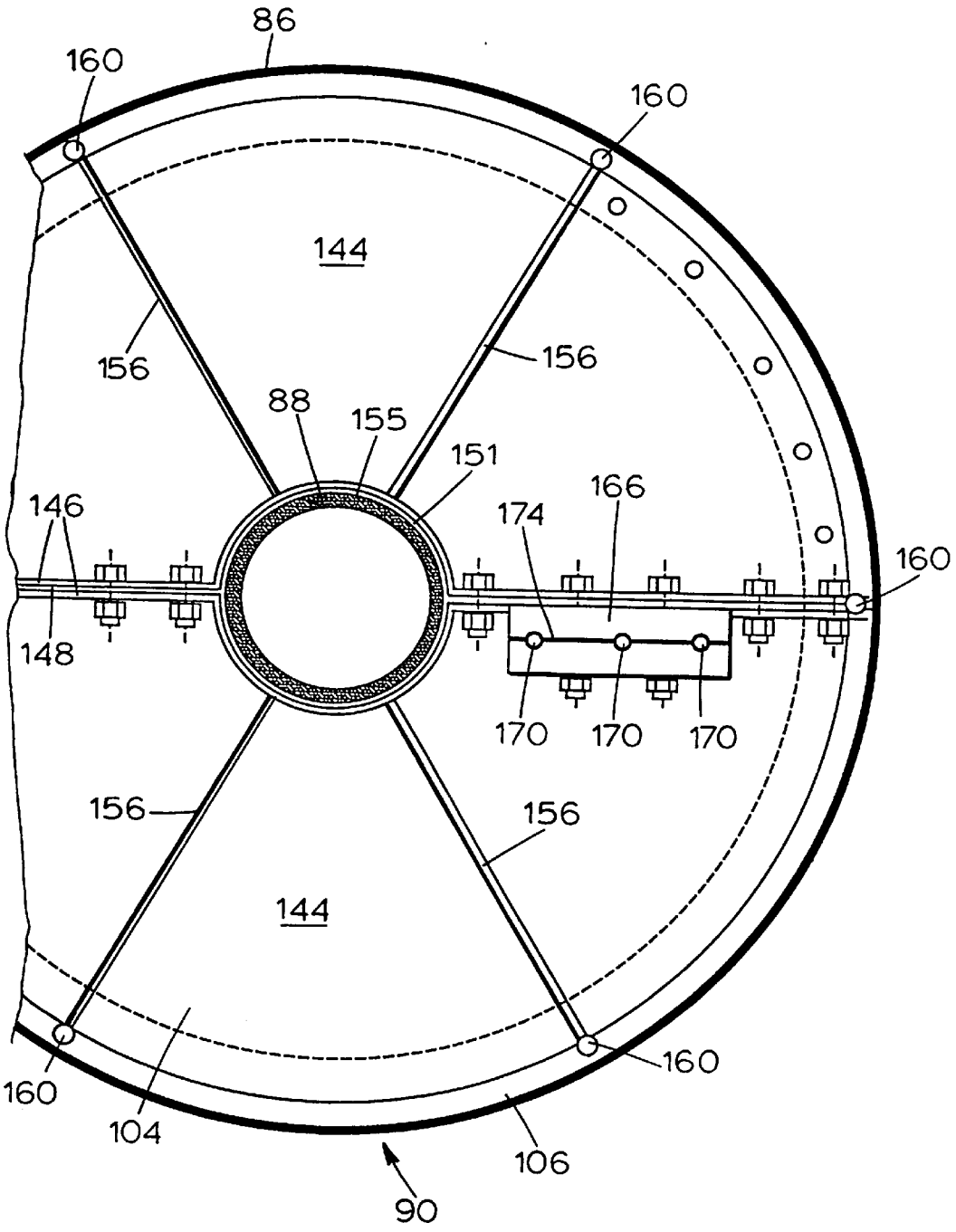
FIG. 5 is a partial plan view of a seal inside a tube of the present invention.

Referring now to FIGS. 4 and 5 there are depicted details of the seals 90 and related components. At the outer boundaries of the illustrations there is depicted the low pressure tube 86 having the bore 92 substantially sealed by a seal 90. A discharge pipe 88 is also depicted. The seal 90 includes a seal plate 104 and seal wipers 106, as described above. The seal wipers 106 are bolted to a substantially horizontal seal plate 104 with an appropriate bolt and washer arrangement 142. The seal plate 104 is substantially semi-circular plates 144 bolted together at upwardly extending flanges 146 to enable easy installation of the seal 90 around a discharge pipe 88. The interface between the upwardly extending flanges 146 is preferably sealed with a flange gasket 148.

The seal 90 defines a round orifice 151 through which the discharge pipe 88 extends. The interface between the discharge pipe 88 and the round orifice 151 is preferably sealed with a discharge pipe gasket 155. As described above, the seal is fixed to the discharge pipe 88 and this is accomplished with the semi-circular plates 144 being bolted together in such a manner as to frictionally engage the discharge pipe 88 with a clamping Action. Also extending upwardly from the semi-circular plates 144 are a number of plate stiffeners 156 that provide stability for the seal 90.

Near the outer perimeter of the plate stiffeners 156 and the upwardly extending flanges 146 are bumpers 160 that extend radially outward past the seal plate 104 to engage the low pressure tube 86 should the seal 90 move laterally. In this manner, the seal wipers 106 are prevented from being crushed. Suitable bumpers can be made of half of a round pipe welded to the upwardly extending flanges 146 and plate stiffeners 156.

Also depicted in FIGS. 4 and 5 is a cable support block 166 which supports electrical cables 54 that provide power for the pump 32. The cable support block 166 is divided into two halves defining orifices 170 at the interface through which the electrical cables 54 extend. A suitable block gasket 174 at the interface of the two block halves is provided. Another gasket 178 is positioned beneath the cable support block 166 to seal the interface between the cable support block 166 and the seal plate 104. The two block halves are bolted together to clamp the electrical cables 54 in the orifices 170. In this manner the cables are supported by the seal 90 in such a friction fit relationship so as to raise the electrical cables 54 with the seals 90.

Depicted in FIG. 4 is a pipe segment which includes a pipe segment flange 188. The pipe flange 188 is mated to a similar flange on an adjacent pipe segment (not illustrated) and the two are joined and sealed by a high pressure mechanical coupling 100. An optional lifting and hold bar 192 is fixed to the pipe for being connected to a crane fitting (not illustrated) during installation and removal from the tank.

Figure 6:
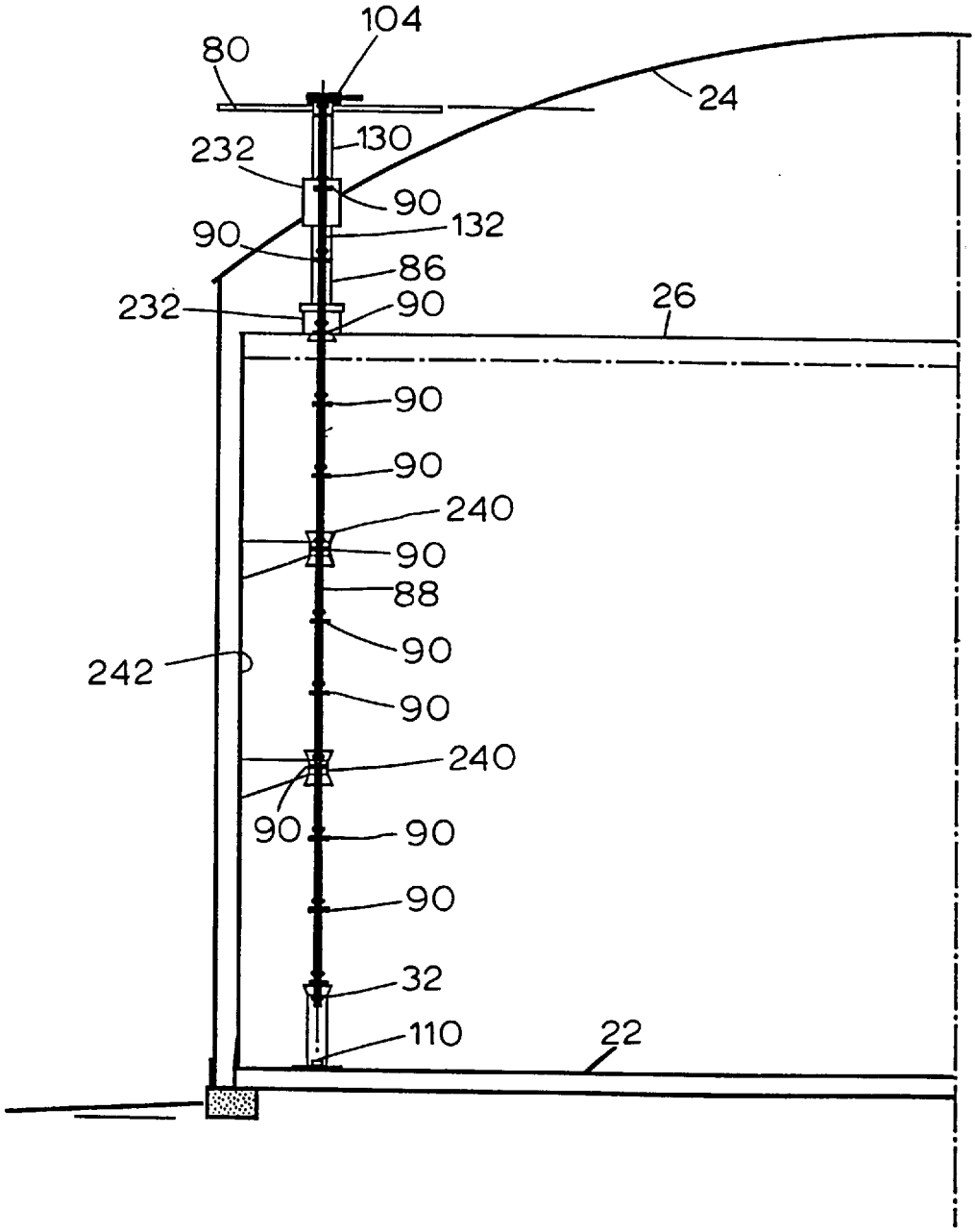
FIG. 6 is an elevational view tank having lateral bracing for a discharge pipe in accordance with the present invention.

Referring now to FIG. 6, there is depicted a tank having a submerged pump removal system 20 positioned near the tank roof 24. As described above, the submerged pump removal system 20 includes at its upper end a work platform 80 a downwardly extending low pressure tube 86, a discharge pipe 88, and a number of seals 90. The low pressure tube 86 is accessible from work platform 80, and a number of thermal insulators 232 are provided to reduce heat transfer from external sources into the tank through the discharge pipe 88.

Two discharge pipe guides 240 are joined to a tank innerwall 242 as illustrated in FIG. 6. The discharge pipe guides 240 define openings therethrough to accommodate the discharge pipe 88. The discharge pipe guides 240 are bell-shaped at their top and bottom ends to guide the seals 90 into a central portion. The central portion is approximately the same diameter as the low pressure tube 86 so that when the seal 90 is positioned in the discharge pipe guide 240 it is restrained from lateral movement as was described above with respect to FIG. 4 so that the bumpers 160 will engage the discharge pipe guide 240 as the discharge pipe 88 moves laterally.

The foregoing detailed description of drawings has been provided for clearness of understanding only and no unnecessary limitations therefrom should be read into the following claims.

I claim:

1. Apparatus for removing a pump from a tank containing cryogenic fluid, comprising:

a tube having a bore therethrough;

a discharge pipe extending through the tube bore, and having means for being connected to a pump discharge;

a first seal joined to the discharge pipe at a first elevation;

a second seal joined to the discharge pipe at a second elevation below the first seal elevation, the second seal spaced apart from the first seal to define a vent zone therebetween;

a third seal joined to the discharge pipe at a third elevation below the second seal elevation, the third seal spaced apart from the second seal to define a purge zone therebetween; and means for purging the purge zone.

2. The apparatus of claim 1 and further comprising:

a fourth seal joined to the discharge pipe at an elevation below the third seal;

means for raising the discharge pipe through the tube bore to sealably engage the tube bore with the fourth seal and define a second purge zone between the third seal and the fourth seal; and means for purging the second purge zone.

3. The apparatus of claim 1 and further comprising:

a plurality of seals joined to the discharge pipe at spaced apart elevations below a lower end of the tube;

means for pulling the discharge pipe through the tube bore to serially engage the tube bore with each seal to define successive purge zones with a seal at the next higher elevation; and means for purging each successive purge zone within the tube bore.

4. The apparatus of claim 3 in which the tube comprises a cone-shaped lower opening for guiding seals into the bore as the discharge pipe is raised through the tube bore.

5. The apparatus of claim 1 and further comprising:

a pump seal having means for being connected to a bottom side of a pump at an elevation below the third seal elevation; and means for pulling the discharge pipe through the tube bore to sealably engage the tube bore with the pump seal at the third elevation to define a pump purge zone therebetween.

6. The apparatus of claim 1 in which the means for purging the purge zone comprises:

a purge tube in fluid communication with the tube bore at a fixed elevation between the second seal elevation and the third seal elevation; and means for feeding inert gas through the purge tube and into the purge zone.

7. The apparatus of claim 1 in which the first seal the second seal, and the third seal each comprise:

an electrical cable orifice; and an electrical cable orifice seal.

8. The apparatus of claim 1, and further comprising:

bracing means for stabilizing the discharge pipe, the bracing means joined to the discharge pipe and comprising;

a plurality of spaced apart bumpers joined to and extending outward from each seal.

9. The apparatus of claim 1 in which at least part of the tube is disposed in a cryogenic fluid storage tank.

10. The apparatus of claim 1 in which the discharge pipe includes a plurality of pipe segments joined with high-pressure pipe couplings.

11. The apparatus of claim 1, and further comprising:

a purge zone vent for releasing fluid from the purge zone.

12. The apparatus of claim 1 and further comprising:

a vent for releasing fluid from the venting zone.

13. The apparatus of claim 1, and further comprising:

a torque-resistant pump seat having means for being mounting to a pump.

14. The apparatus of claim 1 in which the tube is disposed in the cryogenic storage tank and the apparatus further comprises:

an extension skirt mounted on the tank roof, having a bore therethrough concentrically aligned with the tube bore for slidably receiving the discharge pipe, the seals, and a pump.

15. The apparatus of claim 1 in which an upper end of the tube is spaced above the cryogenic liquid level in the tank.

16. The apparatus of claim 1 and further comprising:

discharge pipe lateral bracing comprising;

a stationary brace tube through which the discharge pipe is disposed; and brace tube bumper means mounted on each seal.

17. The apparatus of claim 1 in which an upper end of the tube is spaced above the cryogenic liquid level in the tank.

18. The apparatus of claim 1 and further comprising:

discharge pipe lateral bracing comprising;

a brace tube through which the discharge pipe and seals are disposed; and brace tube bumper means mounted on each seal.

19. The apparatus of claim 18 and further comprising:

an electrical cable hanger fixed to the discharge pipe.

20. The apparatus of claim 18, and further comprising:

bracing means for stabilizing the discharge pipe, comprising;

a plurality of vertically spaced apart struts mounted in the tank, and a discharge pipe guide mounted on each of the struts.

21. The apparatus of claim 18 in which at least part of the tube is disposed in a cryogenic fuel storage tank.

22. The apparatus of claim 18, and further comprising:

a purge zone vent for releasing fluid from the purge zone.

23. The apparatus of claim 18 in which a lower end of the tube is spaced above the cryogenic liquid level in the tank.

24. Apparatus for removing a pump from a tank, comprising:

a tube having a bore therethrough;

a discharge pipe disposed in and extending through the tube bore, the discharge pipe including a pump mount;

a first seal joined to the discharge pipe at a first elevation;

a second seal joined to the discharge pipe at a second elevation below the first seal elevation, the second seal spaced apart from the first seal to define a vent zone therebetween;

a third seal joined to the discharge pipe at a third elevation below the second seal elevation, the third seal spaced apart from the second seal to define a purge zone therebetween;

a pump seal including a pump mount at an elevation below the third seal elevation;

means for pulling the discharge pipe through the tube bore to sealably engage the tube bore with the pump seal to define a second purge zone; and means for purging the first and second purge zones.

25. The apparatus of claim 24 in which the means for purging the first and second purge zones comprises:

a purge line in fluid communication with the tube bore.

26. The apparatus of claim 24 and further comprising:

a fourth seal joined to the discharge pipe at an elevation below the third seal; and means for raising the discharge pipe through the tube bore to sealably engage the tube bore with the fourth seal and define a second purge zone between the third seal and the fourth seal.

27. The apparatus of claim 26 in which the tube comprises a cone-shaped lower opening for guiding seals into the bore as the discharge pipe is raised through the tube bore.

28. The apparatus of claim 24 and further comprising:

a plurality of seals joined to the discharge pipe at spaced apart elevations below a lower end of the tube;

means for pulling the discharge pipe through the tube bore to serially engage the tube bore with each seal to define successive purge zones with a seal at the next higher elevation; and means for purging each successive purge zone within the tube bore.

29. The apparatus of claim 24 in which the means for purging the purge zone comprises:

a purge tube in fluid communication with the tube bore at a fixed elevation between the second seal elevation and the third seal elevation; and means for feeding inert gas through the purge tube and into the purge zones as they pass the purge tube fixed elevation.

30. The apparatus of claim 24 in which the first seal the second seal, and the third seal each comprise:

an electrical cable orifice; and an electrical cable orifice seal.

31. The apparatus of claim 24, and further comprising:

bracing means for stabilizing the discharge pipe, the bracing means joined to the discharge pipe and comprising;

a plurality of spaced apart struts extending laterally outward from the discharge pipe, and a tank wall bumper joined to each strut.

32. The apparatus of claim 24 in which at least part of the tube is disposed in the cryogenic fluid storage tank.

33. The apparatus of claim 24 in which the discharge pipe includes a plurality of pipe segments joined together with high-pressure pipe couplings.

34. The apparatus of claim 24, and further comprising:

a purge zone vent for releasing fluid from the purge zone.

35. The apparatus of claim 24, and further comprising:

a vent for releasing fluid from the venting zone.

36. The apparatus of claim 24, and further comprising:

a torque-resistant pump seat having means for being mounted to a pump.

37. The apparatus of claim 24 in which the tube is disposed in the cryogenic storage tank and the apparatus further comprises:

an extension skirt mounted above the tube having a bore therethrough concentrically aligned with the tube bore for slidably receiving the discharge pipe, the seals, and a pump.

38. Apparatus for removing a pump from a tank containing a cryogenic fluid, comprising:

a tube having a bore therethrough;

a first seal joined to the tube bore and having an orifice therethrough;

a second seal joined to the tube bore and having an orifice therethrough, the second seal spaced apart from the first seal to define a purge zone therebetween;

a discharge pipe extending through the tube bore and the seal orifices, and having a pump mount;

means for purging the purge zone with inert gas; and means for raising the discharge pipe through the tube bore and seal orifices.

39. A method for removing a pump and an associated discharge pipe from a tank containing cryogenic fluid, the discharge pipe extending through a tube bore, the method comprising the steps of:

sealing the tube bore with a first seal joined to the discharge pipe at a first elevation;

sealing the tube bore with a second seal joined to the discharge pipe at a second elevation spaced apart from and below the first elevation to define a vent zone;

sealing the tube bore with a third seal joined to the discharge pipe at a third elevation spaced apart from and below the second elevation to define a purge zone;

venting the vent zone;

purging the purge zone;

raising the discharge pipe to remove the first seal from the tube bore, the second seal to the first elevation, and the third seal to the second elevation;

sealing the tube bore with a plurality of successively lower seals joined to the discharge pipe by raising each successive seal to the third elevation to define a new purge zone with a seal at the second elevation;

purging the new purge zone; and removing the pump from the tube bore.

40. A method for removing a pump and an associated discharge pipe from a tank containing cryogenic fluid, the discharge pipe extending through a tube bore, the method comprising the steps of:

sealing the tube bore around the discharge pipe at a first elevation, sealing the tube bore around the discharge pipe at a second elevation spaced apart from the first elevation to define a purge zone therebetween;

purging the purge zone with inert gas; and raising the discharge pipe and the pump through the purge zone.

41. The method of claim 40 in which the step of sealing the tube bore at the first elevation comprises the step of:

disposing a seal around and in wiping contact with the discharge pipe.

42. The method of claim 40 in which the step of purging the purge zone comprises the steps of:

feeding inert gas into the purge zone; and venting purged gas from the purge zone.

* * * * *